US006099928A

United States Patent [19]

Chee

[11] Patent Number: 6,099,928

[45] Date of Patent: Aug. 8, 2000

[54] MULTIPURPOSE TRANSPARENCY MAT CARDS

[76] Inventor: Jeffrey Jock Fai Chee, 45-093 Namoku St., Kaneohe, Hi. 96744

[21] Appl. No.: 08/962,469

[22] Filed: Oct. 31, 1997

Related U.S. Application Data

[60] Provisional application No. 60/030,021, Nov. 1, 1996.

[51] Int. Cl.[7] ..... B44F 1/06; G09F 1/10

[52] U.S. Cl. ..... 428/40.1; 40/768; 40/771; 40/774; 428/13; 428/14; 428/42.1; 428/121; 428/137; 428/138; 428/156; 428/194; 428/913.3

[58] Field of Search ..... 428/13, 14, 40.1, 428/46, 142, 913.3, 194, 42.1, 121, 131, 137, 138, 156; 40/768, 771, 774

[56] References Cited

U.S. PATENT DOCUMENTS

| | | | |
|---|---|---|---|
| 4,231,833 | 11/1980 | Lieberman | 428/14 |
| 4,662,093 | 5/1987 | Suttles | 428/14 |
| 4,678,689 | 7/1987 | Phillips | 428/13 |
| 5,149,571 | 9/1992 | Croell | 428/43 |
| 5,322,723 | 6/1994 | Bickett | 428/43 |

*Primary Examiner*—Nasser Ahmad
*Attorney, Agent, or Firm*—Martin E. Hsia

[57] ABSTRACT

A transparency mat card comprising a mat with a window and a transparency mounted in the window using a weak, removable glue applied to portions of a glue border so that the transparency can be detached intact from the mat card. A picture or other visual pattern is preferably printed or otherwise marked on the transparency, preferably on the rear surface.

21 Claims, 5 Drawing Sheets

MULTIPURPOSE TRANSPARENCY MAT CARDS

This application claims the benefit of U.S. Provisional Application Ser. No. 60/030,021 filed Nov. 1, 1996.

BACKGROUND OF THE INVENTION

This is a continuation in part of provisional patent application 60/030021, filed Nov. 1, 1996.

This invention relates to greeting cards, in particular, to transparency mat cards.

Greeting cards are used to commemorate special occasions, such as birthdays or weddings, or to express particular emotions, such as appreciation and thank you or sympathy and apology. To carry out their function, greeting cards sometimes have special messages printed on the inside or outside of the card. Other cards are without greeting, allowing the sender to inscribe a message.

Presently, there is a variety of art greeting and note cards on the market. These cards range in quality and originality from original photographs and artwork to prints or reproductions of original photographs, paintings, drawings, or other artwork. Each original or reproduced work may be individually glued onto a piece of card stock with or without a debossed or embossed border. Each picture may also be glued onto the front board of a two-piece card stock which has been hinged along one edge or onto the back board of the folded card stock with a window on the front board. Sometimes a folded inside cover sheet is used to display the picture. Prints or reproductions may be placed on a single piece of card stock or on the front board of a two-piece card stock. All of these art originals, prints or reproductions can be viewed only from the front and must be well lit to be seen.

As it relates to greeting cards, this invention has the following objects:

To provide distinctive and unusual greeting cards that are economical, high quality, aesthetically appealing, fine art originals, and original reproductions, as well as "make-your-own" cards which will allow users to become their own "artist." These cards would also include artwork based on small animation cels, high-quality dye-sublimation computer printed cels, and original or photographic digital transparencies, as well as analog photo or original transparencies and regular offset photo or original transparencies.

To provide distinctive and unusual fine art greeting cards which can have various reuses after being used as a greeting card. These reuses include, but are not limited to, use as a framed picture or a transparent window stick-on decoration, a mobile, Christmas ornament or earring. Reuses might also include the decorations for card games, shirt "glue-ons," bathtub stick-ons, tattoos, transparent candy confection pictures, and processed fruit preserves rolls (sometimes sold under the trademark "Fruit Roll-Ups") in a cellophane wrapper.

To provide greeting cards that have original prints or reproductions that not only can be viewed from the front in good lighting, but can also be viewed from behind and from side angles with back or side lighting. These greeting cards may also be viewed from various angles in dim light, in which case the pictures take on an opaque yet translucent appearance.

To provide fine art greeting cards that can be easily and economically manufactured and mass produced.

To provide a product which could also be sold to the user as a do-it-yourself kit for making unusual original, individualized greeting cards. This kit might include mat cards, transparency film, a camera capable of taking photographs for the appropriate sized transparency for the cards, and glue. Another type of kit could include a mat card, blank transparency and glue so that users could create their own design on the card.

SUMMARY OF THE INVENTION

These and other objects of the invention are achieved by a transparency mat card comprising a mat card having a window with a transparency preferably mounted in the window using a weak, removable glue applied to portions of a glue border on the transparency so that the transparency can be detached intact from the mat card. A picture or other visual pattern is preferably printed or otherwise marked on the transparency, preferably on the rear surface. Preferably, the mat card is folded to form a front portion and a back portion, and the window is cut out of the front portion. Optimally, the transparency is mounted on the rear surface of the front portion, aligned with and behind the window, with a weak, removable glue adhering a glue border around the edge of the front of the transparency to a corresponding glue area around the edge of the rear of the window.

The transparency can be of any material and can contain portions that are clear, translucent or opaque, in any combination, color or proportion. Several media may be employed in the transparency-making process. These include, but are not limited to, plastics or plastic derivatives; flexible, unbreakable glass or similar materials; ultra-thin veneer; mylar sheeting; transparent or translucent paper; natural and artificial lace art webbing; natural and artificial silk or cloth, and metallic transparencies or light activated or chemically produced images or any combination of the above.

A mat card can have any of the following features:

A folded mat hinged to open along one of its edges.

A folded mat containing multiple hinges.

A surface which might be textured or untextured, patterned or plain.

A flat-folded mat that opens to form a three dimensional structure.

A mat material that might be opaque, transparent, or translucent, in single or multiple layers.

A shape which might be square, rectangular, circular, triangular, oval, polygonal or free-form/amorphous.

A colored to non-colored mat material depending on the desired artistic effect of the transparency mat card.

One or more folded or unfolded mats spaced apart or adjacent to each other with window(s) in one or more of the mats of any shape and size combination.

The transparency may be hinged, taped, glued, or self-adhered to the mat. The method of adhesion might include (but is not limited to) spray, applied liquid or film tape, card press adhesion, and self-adhering film. It may be screened using any screening material such as a silk screen. It may also be mechanically glued by tool or machine, or by various hand methods. A full range of glues may be used depending upon the completed aesthetic effect to be achieved.

Preferably, the transparency is glued to a front or back part of the mat in such a way that light is allowed to pass through some part of the picture plane. A transparency (including a slide transparency) of any size may also be glued inside a three-dimensional picture structure formed by the mat card. This could also include an elastic transparency which changes its shape upon the angle of opening of the mat card "front" and "back." Various decorative embellishments may also be incorporated, thus giving the front-front surface(s) and back-back surface(s) a sculptural free-form appearance.

The transparency preferably comprises a picture with a glue border around the picture. A window (preferably having a debossed border) large enough for the picture to be seen through is formed in the mat card. The transparency is preferably attached to the mat by applying a weak glue to the rear surface of the mat adjacent to the window, and then bringing the "glue border" into contact with the glue while the picture is aligned with and visible through the window. Obviously, the glue may instead be applied to the glue border on the transparency, and then the glue border may be brought into contact with the "glue area" surrounding the window of the mat card.

In the preferred folded mat card with front and rear portions, messages or greetings can be written on either side of the back portion of the card. Messages such as doodles, extra notations, advertisements, or announcements may be written on the front portion of the card as well. Messages or decorative elements may be added to the transparency or to the mat card by the manufacturer, or by the consumer, or by the consumer in concert with the manufacturer (as in coloring books, or "paint by number" works). Writing or printing may be accomplished with any apparatus or technique which may produce a mark on the transparency, mat, or card, including light, chemical spectrum marks or aging process marks. It is also possible that transparencies may be hinged, folded or inserted into the card, or that the card may be hinged, folded or inserted into the transparency. For example, the card could be a trifold with two aligned window sections joined and the transparency placed at the window within the joined sections. This construction could be repeated with an aligned window section on the third fold so that the transparencies could be viewed from the front and the back.

A second presently preferred method of adhering the transparency to the mat card is to use various types of self-adhesive labels (permanent and removable) in shapes which are visually and structurally complementary to the mat card or transparency. The labels could extend over portions of both the mat and the transparency, or could be adhesive on both sides.

Some preferred shapes for these labels are as follows:

Strip labels that extend the length of one side of the transparency (one label per side).

A full frame cut-out label that fits exactly over the perimeter edge of the picture transparency and is applied with a special apparatus designed to place the label exactly square upon the transparency's edges.

"L"-shaped corner labels which adhere the corners of the transparency to the mat card. Appropriate-sized dot labels which adhere the corners of the transparency to the mat card.

Other various shaped labels, each shape utilized according to practical and aesthetic appeal for each transparency and mat card grouping.

Labels are preferably matched in color and/or material to the card stock used in each instance. However, labels may contrast with card stock and design, if a certain aesthetic look is desired. An example would be deco-edged labels or off-center stamp labels which could vary (through computer programming) to the point of giving a random feel to the manufactured look of the card. If the labels were removed, the transparency could be used for another purpose (for example, a "sun catcher" or a transparent adhered window picture).

Alternatively, "photo corners" (small triangular pockets structured to receive corners of photographs for mounting) could be used to mount the transparency in place on the mat card.

Another alternative method for mounting the transparency would be to create a stripping having a groove formed therein, and then gluing the stripping around the window of the mat, and then sliding the transparency into the grooves so that the transparency is removably mounted over the window.

Each transparency is preferably easily removed from the card's mat without damage, as the glue used to adhere the picture to the rear surface of the front mat is preferably weak and flexible. Stiff glue may also be used if the mat card necessitates a rigid adhesive. The adhesives may vary from the flexible to rigid and may be of varying degrees of adhesion and permanency. Also, depending upon the requirements of the particular product at hand, glue/adhesive/solvents may or may not be colored and may vary depending upon the product means and requirements. Adhesives may be applied in simultaneous or consecutive layers or operations.

A background mat in a different color from the front mat may be used for framing purposes. Alternately, the "back" and "front" mat can be a composite of colored and shaped mats, such as in a collage board. Both front and back mats may be of any combination of color and shape, or both, and may be in any adjacent or tangent proximity to one another. The material used in the mat of this invention is preferably classic linen card stock, but wood or wood veneer (natural and human made), possibly lacquered, laminated, or textured, could be used in place of card stock. The two pieces, front and back, may be hinged by an invisible wood pulp tape. Likewise any thin material such as flexible plastic sheets, flexible glass, or ceramic-based or metallic-based materials might be used as a mat.

A mat card can contain any number of mats, such as consecutive hinged mats that become three dimensional shapes such as a box, cylinder, prism, tube, egg, or polyhedral when unfolded.

Preferably, the front surface of the mat is provided with a debossed border around the window. However, the card may have an embossed border and may have three-dimensional or low-relief windows which are movable or fixed or may scale down to have no border at all. Moreover, the card might itself be a transparency with no window at all, as in a transparency mat card which is integrally formed of the same or varying light transmitting material. In the case of this last example, the picture may be printed directly on or made into a transparent or translucent mat as a complete one piece detachable transparency mat card. If a border is used, it may be embossed, stamped, blind-stamped, or pin lined, or it may be made of the card stock. It may be also a straight and regular border, or angular, curved, free-form or irregular.

Preferably, a rear mat is integrally formed with and attached to a front mat by forming a single fold in a single mat card. The fold of the card may be a single center fold or of varying degrees to right or left, top or bottom or across the centerline of each half mat to form half folds or a door-like effect. Multiple fold(s) or a series of folds or a configuration of folds may be used as in an accordion, screen panel, or origami. Folds may be at right angles or at any degree off of any line, point or plane and consisting of any line, point or plane contained or not contained within or without the mat card. Folds may be mechanical (as in a hinge), handmade (use of tools included) or steamed, heated, melted (as in a plastic paper card), bent by light, sound, air, or water. The fold might also be accomplished by chemical application, as well as by means of a machine devised for the specific purpose.

A fold may be of any shape or pattern, both regular or irregular. Optionally, separate pieces of paper of any color or size, foldable to form any symbol, letter, or other object as in origami, can be attached to the mat.

The border may be formed directly in the mat. Alternatively, the foldable paper can be integrally formed with the mat card by appropriate cutting of the mat card material and scoring the material along the fold lines or of another material of any size, shape, or color attached to the mat. The border may or may not be fully, partially, or not at all attached to the fold itself. It can also be the fold itself. A fold may be indicated but not actually accomplished as in a flat transparency mat card designed to be connected, hung, or displayed or as in a trompe d'oeil painted card where the fold or even the entire transparency mat card is designed to create an artistic illusion.

An alternative transparency mat card could be an entire card that is produced by printing on a transparency sheet, with die scoring (or other scoring) of a perimeter outline around a picture area on the sheet. An insert or a paper sheet could be provided for writing a message.

Images for the transparency mat cards are preferably based upon original art work that would be scanned or artwork that is originally created in a digital medium. Images would then be manipulated for any desired artistic effects such as color, texture, dimensions, layering, montaging, and other image manipulation techniques to yield the final product. Even if only exact reproduction is desired, image manipulation may be preferable because the original artwork is probably printed on an opaque medium. Thus, the colors and textures may need to be rebalanced and adjusted for reproduction on a transparency. It is preferred to use a color laser printer driven by a computer, with artwork scanned into the computer by a scanner. It has been found that this combination avoids the need for rebalancing of colors.

Output would preferably be produced using any digital imaging technology now known or later developed, such as, but not limited to, color ink jet, toner-based color laser printers, dye sublimation printers, wax transfer printers, color plotters, film recorders, holography, three-dimensional coherent light imaging systems, LCD matrix displays and other video technology. The original artwork can be digitally transmitted for creation, display or sale of cards at various commercial sites. Whether scanned or originally created in a digital medium, transparency mat card images would be considered original art, even when an original image is "enhanced" digitally to provide variations of the original artwork.

Transparencies may be made on a printer capable of reproducing images in sufficient numbers for desired card production, or a color copier with an original master sheet bearing digital, photographic, hand-done or artistically manipulated image(s). The images may be in a two-dimensional or three-dimensional set-up and may be multiple or singular in number and content.

Transparencies may be emulsion-coated and photographically reproduced through various artistic operations to achieve fine mass-produced images. This process can be extended to the buyer so that he or she can create an individual emulsion-coated transparency image.

Art work manipulation could also take the form of abstractions of the original work based upon "programmed" computer manipulations which in turn are based upon randomization of digital effects to create "perceived imperfections" to enhance the original image. Images may be manipulated to allow for conformity with textures, shapes or mounting media.

DESCRIPTION OF THE DRAWINGS

The presently preferred card is 5"×7", folded with a 3" square opening and 3/32" debossed border. An insert 5"×7" of information pertaining to various reuses of the card is preferably included. The card owner is encouraged to utilize his/her own imagination in devising further artistic or decorative uses for the same card. The presently preferred card, 5"×7", may be oriented with respect to the transparency so that it opens from the side of the transparency to create a free-standing picture, but may also be oriented so that it opens from the bottom or top.

FIG. 3 is a bottom plan view of the preferred embodiment of the present invention with the transparency glued in.

DESCRIPTION OF THE PRESENTLY PREFERRED EMBODIMENT

Figure 2:
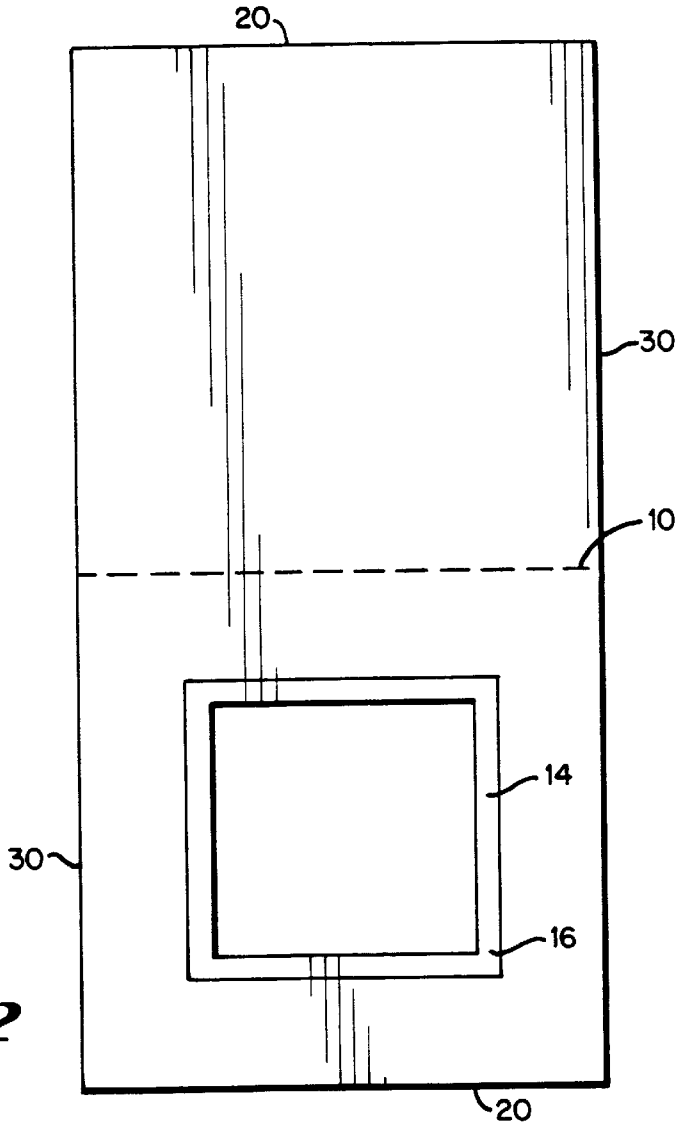
FIG. 2 is a top plan view of the preferred embodiment of the invention's front and back mat without the transparency.
Figure 1:
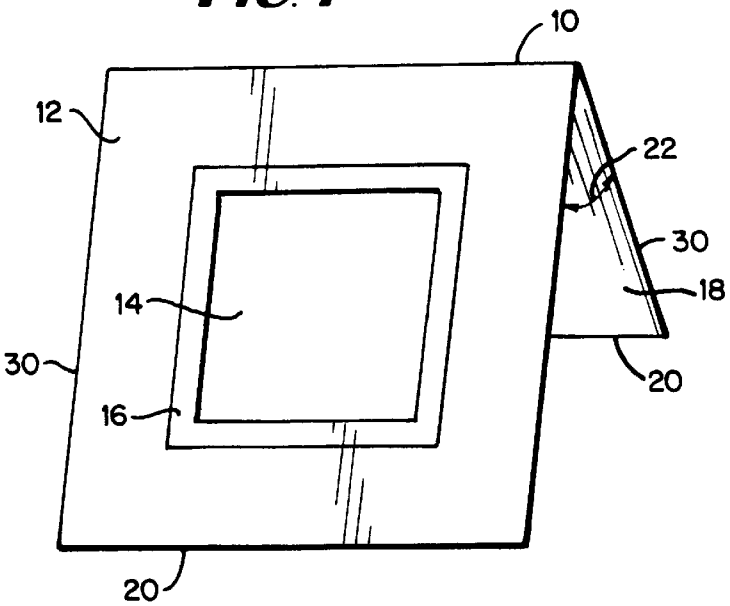
FIG. 1 is a front perspective view of the preferred embodiment of the invention's front and back mat without the transparency.
Figure 1A:
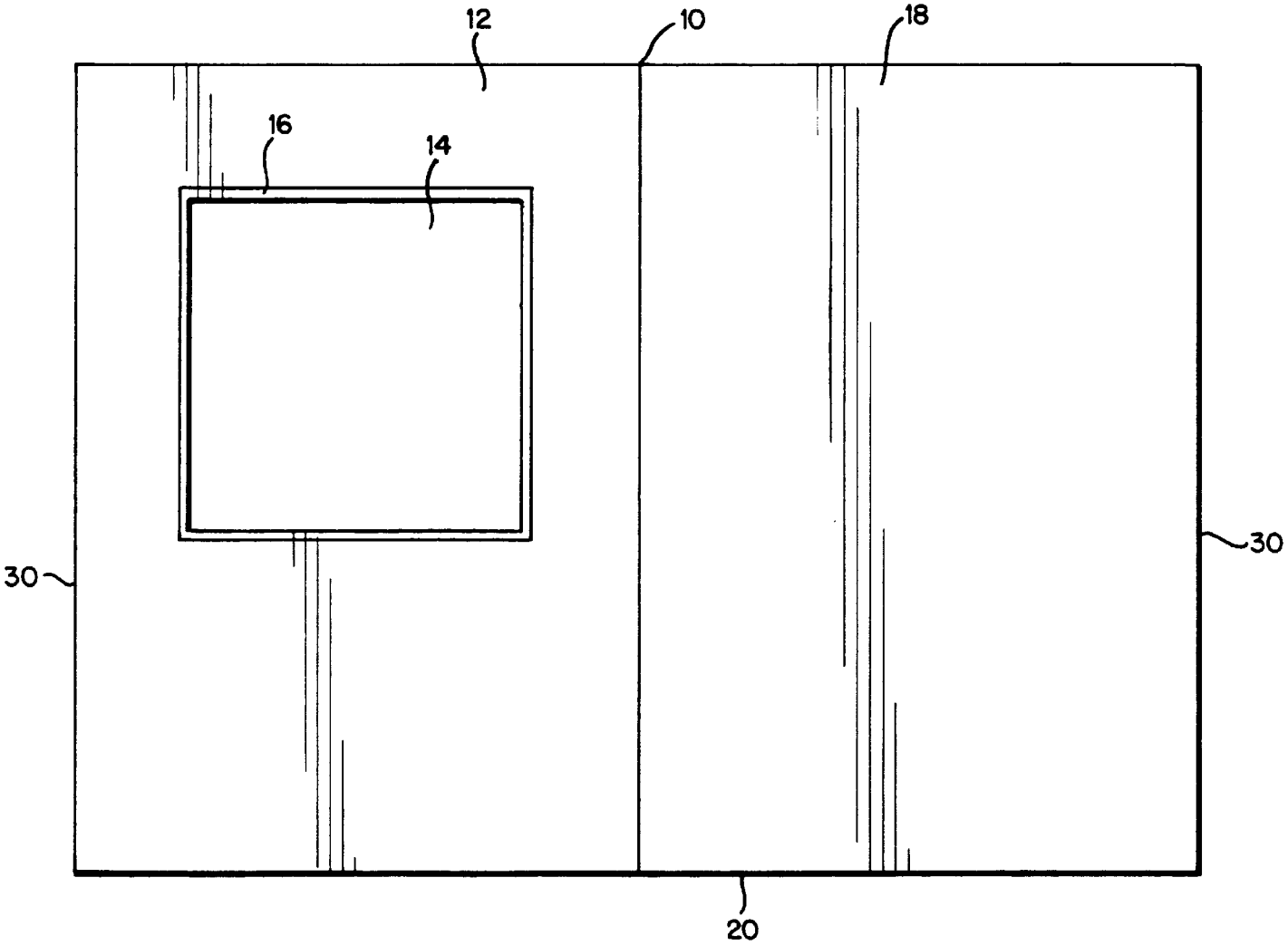
FIG. 1*a* is a front perspective view of the presently preferred embodiment of the invention's front and back mat without the transparency.
Figure 2A:
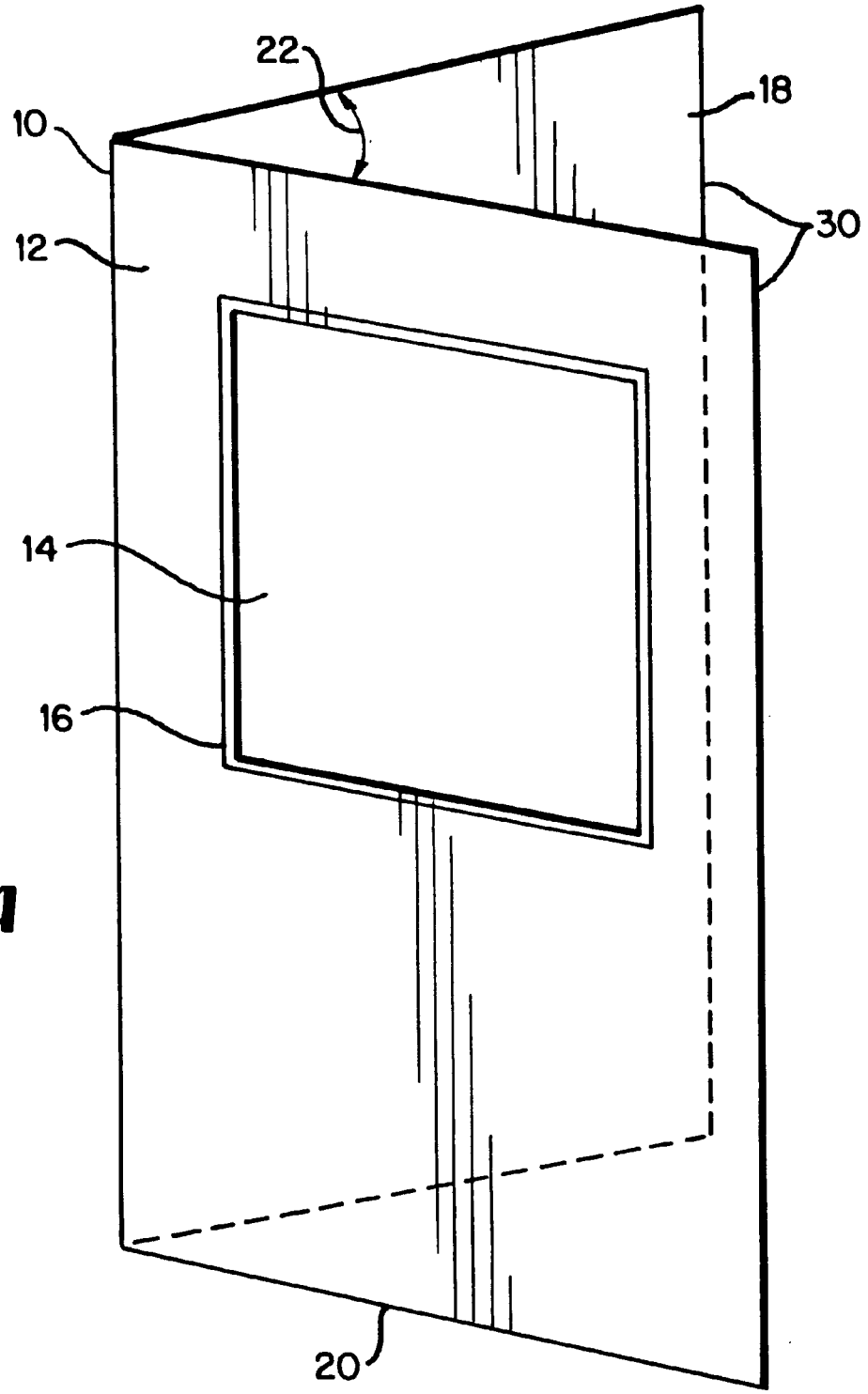
FIG. 2*a* is a top plan view of the presently preferred embodiment of the invention's front and back mat without the transparency.

The greeting card of the presently preferred embodiment of the invention (See FIGS. 1, 1A, 2 and 2A) consists of a front mat 12 and back mat 18 folded along the top edge 10. The front mat 12 has a window 14 in the center, preferably square or rectangular (this window may be of any shape or size, depending on the shape of the card used.) This window preferably has a debossed border 16 around it (the debossed border may be omitted if desired, and another shape or border may be added). The back mat 18 is preferably plain, which allows the sender to write a personal greeting or message on it. The card can be made to stand on its bottom edges 20 by opening it at an appreciable angle 22. The 30 makes up the two sides of the card.

Figure 3:
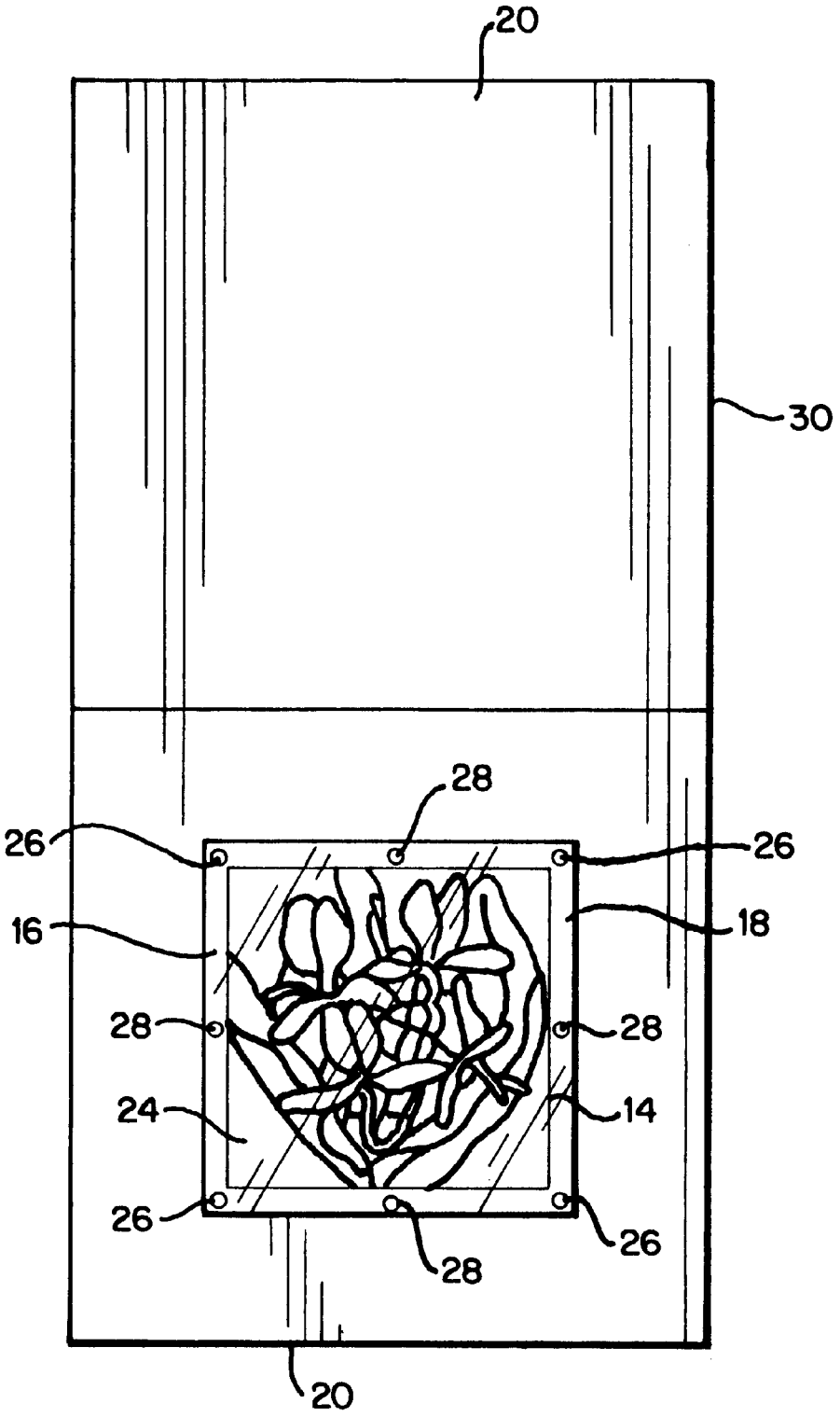

The transparency (see FIG. 3) 24 is preferably trimmed to a size that conforms to the window 14, allowing for a glue border around the window. The transparency can be of any size, but the presently preferred size is 3¼"×3¼", around which preferably ¼" is the glue border 18. The picture is preferably printed on the rear surface of the transparency, not only to protect its color but also to prevent it from being scratched, stained or altered in any fashion that hinders its use and display as a transparency mat card. When a certain artistic effect is to be achieved, the picture may be printed on the transparency sheet on the outward facing side, as in a second version of the card. Techniques such as lithography, serigraphy, low relief, vacu-forming, block printing, etching, painting, crafting, baking, cold set, stamping, puncturing, or perforating may be used.

A weak glue (preferably a 100% silicone adhesive) is preferably applied to the four corners 26 and four midpoints 28 of the rear side of the debossed border of the front mat. The glue may be applied either manually, mechanically, or by being painted on.

A special technique is preferably used when the glue is applied manually. A small opening in the nozzle of the tube of silicone sealant is cut such that when the tube is squeezed, each glue dot that comes out can easily be regulated as to the amount desired. The optimum amount of silicone will ensure that each glue dot will not spread outside the limit of the border (preferably a clear border, approximately ¼" wide) around the transparency when the latter is pressed flat against the reverse side of the front mat during gluing. The object of the gluing process is to adhere the transparency to the mat card. Of course, the glue can instead be placed on a glue area around the window 14 and the glue border of the transparency 24 can be placed over the glue area. Alternatively, the gluing process may be done mechanically by a machine.

Before adhering the transparency to the mat, each picture is placed within the window 14 so that the picture 24 is aligned with the window 14 and the glue border 18 is aligned with the reverse side of the debossed border 16. Preferably, the printed side of the transparency 24 faces inward so that the picture is viewed through the transparent medium when looking through the window from the front. The transparency is situated so that it may be viewed through the front of the front mat. It might also be affixed to the front of the back mat, or to the back of the back mat if there is a window put in the mat back (instead of the mat front or front of the back mat if both mats have some sort of adhesion to the transparency). Also, if both front and back mats have windows cut in them, there may be the option of using two or more transparencies for such a card (A third version of card would include mats and transparencies in stacked, spaced-apart relation, preferably by laminations of mats or transparencies. The effect could be similar to a structural light show and may be achieved through three-dimensional layering, holographic images, animation techniques which imply movement by using overlapping images and transparencies, implied four dimensional images using two or three dimensional diagrams.)

Figure 4:
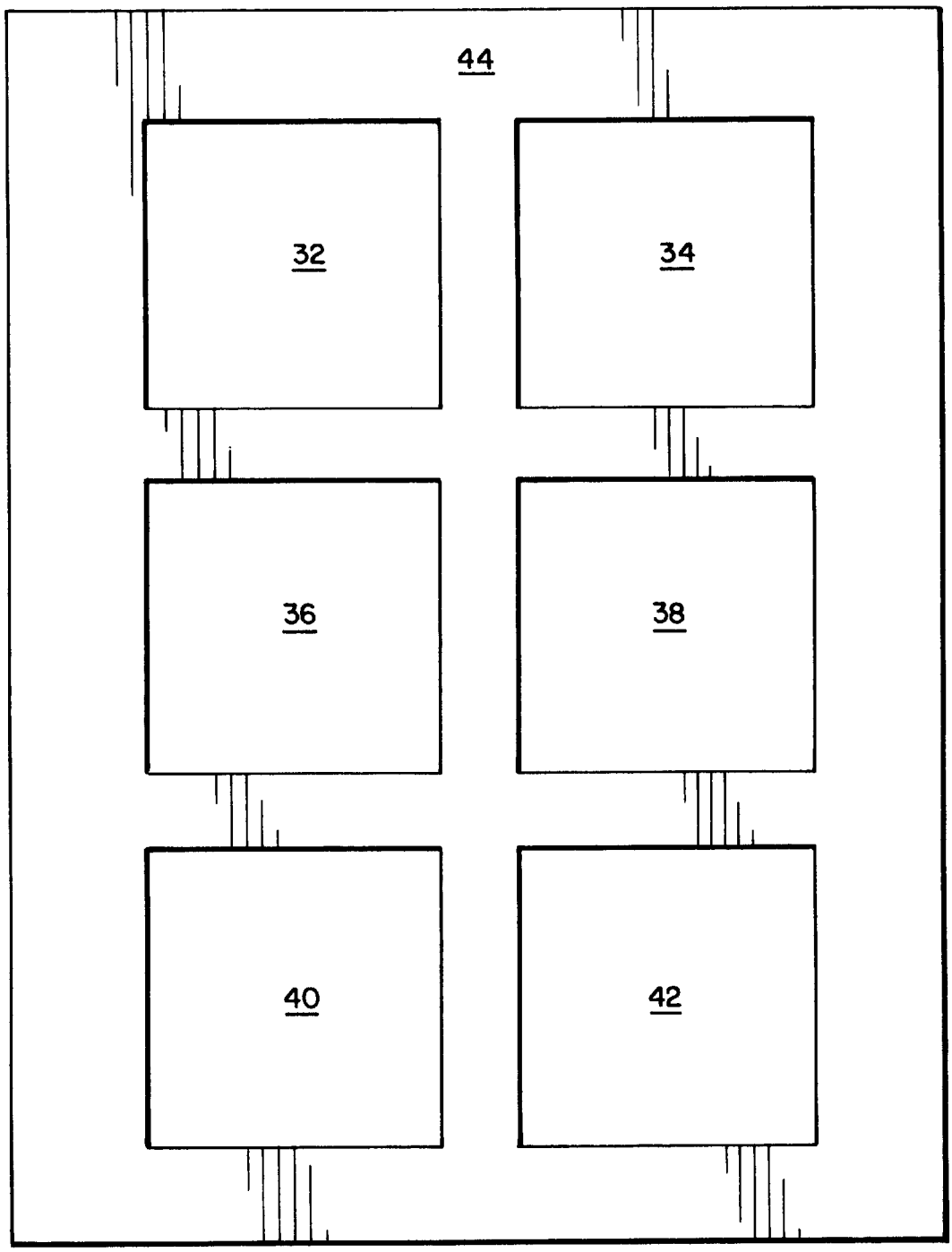
FIG. 4 is a top plan view of a transparency sheet in reverse with six images to be printed on it.

In manufacturing, preferably, six original prints, pictures or photographs, 32, 34, 36, 38, 40, 42, are laid out in such a manner (see FIG. 4) that pairs of images run horizontally from top to bottom of the transparency sheet 44. This layout may vary depending on the desired size, shape and number of pictures used in the card design and the desired effect. Computer enhancement or manipulation of an image can be used. Colors and layout of the designs are also adjusted to achieve the desired effect. The designs are then printed by means of a printer on a clear medium such as an acetate, which is preferred in this instance. Any other clear medium may be used if deemed necessary to achieve the desired effect. These pictures are printed on one or more transparency sheet(s) 34, preferably reversed, on a side designated as the reverse side, so that the pictures properly oriented when viewed through the sheet(s) 34. Each original picture is then trimmed by hand or machine so as to conform to the dimensions of the preferred mat card window(s) and to provide for any necessary glue border.

This product could also be sold to the user as a kit for making individualized greeting cards. This kit might include a mat card, transparency film, a camera capable of taking the appropriate sized transparency for the card, and glue. Another type of kit could include a mat card, transparency, and glue so that users could create their own design on the card.

BRIEF SUMMARY OF THE PRESENT PREFERRED GREETING CARD

The following briefly summarizes the presently preferred transparency mat greeting card:

| | |
|---|---|
| Transparency | |
| SIZE: | 1 13/16" × 1 15/16" to 3⅜" × ¾" |
| MEDIUM: | 8½" × 11" standard to oversize transparency acetate (etched or prepared for a printer or copier) sheet or acetate rolls for web press printing |
| BORDER: | ¼" (included in sizes listed above) |
| Mat | |
| SIZE: | 4¼" × 4¾" to 5⅞" × 11¼" |
| PAPER: | Presently preferred Classic Crest Linen, coverstock, white and natural 26" × 40". Or Exact Vellum Bristol, 80#, white, 26" × 40" sheet |
| WINDOW: | 1 9/16" × 1 11/16" to 3⅛" × 8½" die cut, debossed, or printed line trim preferred |
| BORDER: | ⅛" to 3/16" |
| Envelope | |
| SIZE: | 4½" × 5" to 6⅛" × 11½" |
| PAPER: | Presently preferred Classic Crest Linen, regular weight white and natural 26" × 40". Or Exact Vellum Bristol, 28#, white, 26" × 40" sheet |
| MOST PREFERRED POPULAR SIZES: | |
| TRANSPARENCY: | 1 11/16" × 2¼"<br>1 11/16" × 2⅜"<br>1½" × 2½"<br>1½" × 3⅜"<br>1½" × 3 15/16"<br>2" × 2¾"<br>2" × 3 1/16" |
| MAT: | 4⅛" × 5½"<br>4½" × 6¼"<br>4" × 6¾"<br>3¾" × 8⅝"<br>4" × 8¾"<br>5" × 7"<br>5¼" × 7⅞" |
| ENVELOPE: | 4⅜" × 5¾"<br>4¾" × 6½"<br>4¼" × 7"<br>4" × 8⅞"<br>4¼" × 9"<br>5¼" × 7¼"<br>5½" × 8⅛" |

These materials and specifications have been chosen because they allow the process to be easily standardized. Furthermore, the materials are both economical and easy to procure. They also lend themselves to use in mass production.

What is claimed is:

1. A transparency mat card and a transparency sheet, comprising:

a mat having a window;

a transparency detachably mounted on said mat with a removable glue and aligned with said window, whereby said transparency can be detached intact from said mat without damaging said mat.

2. A transparency mat card and a transparency sheet, comprising:

a mat having a window;

a transparency having a glue border; and a removable glue applied to portions of said glue border and said mat, whereby said transparency is removably mounted in said window and can be detached intact from said mat.

3. A transparency mat card and a transparency sheet, according to claim 2, wherein a visual pattern is marked on the transparency.

4. A transparency mat card and a transparency sheet, according to claim 2, wherein said mat is folded to form a front portion and a back portion, and said window is formed in said front portion.

5. A transparency mat card and a transparency sheet, comprising:

a mat folded to define a front portion and a rear portion, each of said portions having a front surface and a rear surface, said front portion having a window, and said front surface of said front portion having a window border around said window, and said front portion also having a glue area on said rear surface around said window;

a transparency having a printed surface on which a visual pattern is printed, and a glue border around said visual pattern, portions of said glue border corresponding to portions of said glue area when said transparency is aligned with said window; and a removable glue adhering portions of said glue border to corresponding portions of said glue area, whereby said transparency is removably mounted on said rear surface of said front portion, aligned with and behind said window.

6. A transparency mat card and a transparency sheet, according to claim 5, wherein each of said portions is approximately 5 inches by approximately 7 inches, and wherein said window is approximately 3 inches square.

7. A transparency mat card and a transparency sheet, according to claim 5, wherein said glue border and said window border are each approximately ¼ inch wide.

8. A transparency mat card and a transparency sheet, according to claim 5, wherein said mat comprises a material selected from the group consisting of card stock, plastic sheeting, wood, and wood veneer.

9. A transparency mat card and a transparency sheet, according to claim 5, wherein said window border is debossed.

10. A transparency mat card and a transparency sheet, according to claim 5, wherein said window border is embossed.

11. A transparency mat card and a transparency sheet, according to claim 5, wherein said transparency comprises a material selected from the group consisting of plastic, glass, mylar, paper, lace, silk, cloth, cellophane, acetate and photographic transparency.

12. A transparency mat card and a transparency sheet, according to claim 5, wherein said mat portions are between approximately 4⅛ inches to approximately 5¼ inches× approximately 5½ inches to approximately 7⅞ inches.

13. A transparency mat card and a transparency sheet, according to claim 5, wherein said transparency is between approximately 1 11/16 inches to approximately 3⅜ inches× approximately 2¼ inches to approximately 8¾ inches.

14. A transparency mat card and a transparency sheet, according to claim 5, wherein said removable glue comprises:

a 100% silicone adhesive.

15. A transparency mat card and a transparency sheet, comprising:

a mat having a window;

a transparency aligned with and mounted over said window;

self-adhesive labels adhered to said mat and said transparency, whereby said transparency is removably mounted on said window, and can be detached intact from said mat.

16. A transparency mat card and a transparency sheet, comprising:

a mat folded to form a front portion and a rear portion, each of said portions being approximately 5 inches× approximately 7 inches and having a front surface and a rear surface, said front portion having an approximately square window of approximately 3 inches× approximately 3 inches and a debossed window border formed in said front surface around said window, and said front portion also having a glue area on said rear surface around said window;

a transparency having a visual image formed in an approximately square image area of approximately 3 inches×approximately 3 inches and having a glue border around said image area, portions of said glue border corresponding to portions of said glue area when said transparency is aligned with said window; and a removable glue adhering portions of said glue border to corresponding portions of said glue area, whereby said transparency is aligned with said window and detachably mounted in said window, whereby said transparency can be detached intact from said mat.

17. A transparency mat card and a transparency sheet, according to claim 16, wherein said visual image is formed on a rear surface of said transparency and said removable glue is applied to said glue border area on a front surface of said transparency.

18. A transparency mat card and a transparency sheet, comprising:

a plurality of mats, each having a window, and each mat attached to another of said mats;

a transparency detachably mounted in each of said mats with a removable glue, each transparency being aligned with said window in each of said mats, and at least two of said windows being in stacked, spaced apart relation, whereby at least one of said transparencies can be detached intact from one of said mats.

19. A transparency mat card and a transparency sheet, according to claim 18, wherein at least two of said plurality of mats are integrally formed and separated by a fold.

20. A transparency mat card and a transparency sheet, comprising:

a mat;

a transparency having a glue border; and a removable glue applied to portions of said glue border and said mat, whereby said transparency is removably mounted on said mat and can be detached intact from said mat.

21. A transparency mat card and a transparency sheet, comprising:

a mat folded to define a front portion and a rear portion, each of said portions having a front surface and a rear surface, said front portion having a window, and said front surface of said front portion having a glue area around said window;

a transparency having a printed surface on which a visual pattern is printed, and a glue border around said visual pattern, portions of said glue border corresponding to portions of said glue area when said transparency is aligned with said window; and a removable glue adhering portions of said glue border to corresponding portions of said glue area, whereby said transparency is removably mounted on said front surface of said front portion, aligned with and in front of said window.

* * * * *